US009174107B2

(12) United States Patent
Dettor

(10) Patent No.: US 9,174,107 B2
(45) Date of Patent: Nov. 3, 2015

(54) CUSTOMIZABLE ENCLOSURE SYSTEM FOR TENNIS COURTS

(76) Inventor: Todd Dettor, Pompano Beach, FL (US)

( * ) Notice: Subject to any disclaimer, the term of this patent is extended or adjusted under 35 U.S.C. 154(b) by 875 days.

(21) Appl. No.: 13/344,859

(22) Filed: Jan. 6, 2012

(65) Prior Publication Data

US 2013/0175487 A1 Jul. 11, 2013

(51) Int. Cl.

| | |
|---|---|
| ***E04H 17/00*** | (2006.01) |
| ***A63B 61/00*** | (2006.01) |
| ***E04H 17/06*** | (2006.01) |
| ***E04H 17/10*** | (2006.01) |
| ***E04H 17/26*** | (2006.01) |
| ***A63B 71/02*** | (2006.01) |
| *E04H 17/14* | (2006.01) |

(52) U.S. Cl.

CPC ..... *A63B 61/00* (2013.01); *A63B 71/022* (2013.01); *E04H 17/063* (2013.01); *E04H 17/10* (2013.01); *E04H 17/266* (2013.01); *E04H 2017/1473* (2013.01)

(58) Field of Classification Search

CPC .... A63B 61/00; A63B 71/022; E04H 17/063; E04H 17/10; E04H 17/266; E04H 2017/1453

USPC ..... 135/87, 90, 120.4; 256/12.5, 23

See application file for complete search history.

(56) References Cited

U.S. PATENT DOCUMENTS

| | | | | | |
|---|---|---|---|---|---|
| 1,250,429 | A | * | 12/1917 | Carroll | 160/135 |
| 1,482,978 | A | * | 2/1924 | Edwards | 160/84.01 |
| 2,208,458 | A | * | 7/1940 | Julian et al. | 135/87 |
| 2,554,688 | A | * | 5/1951 | Vollweiler | 135/87 |
| 2,785,897 | A | * | 3/1957 | Lennon | 256/23 |
| 3,237,778 | A | * | 3/1966 | Hoodis | 160/327 |
| 3,537,688 | A | * | 11/1970 | Stein | 135/87 |
| 3,590,864 | A | * | 7/1971 | Vechesloff | 135/95 |
| 3,982,758 | A | * | 9/1976 | Howes, Jr. | 473/474 |
| 4,070,427 | A | * | 1/1978 | Romualdi et al. | 264/71 |
| 4,180,867 | A | * | 1/1980 | Ridgeway, Jr. | 135/96 |
| 4,218,047 | A | * | 8/1980 | Douglas | 256/1 |
| 4,280,306 | A | * | 7/1981 | Milinic | 135/906 |
| 4,606,070 | A | * | 8/1986 | Schachter | 135/95 |
| 4,632,138 | A | * | 12/1986 | Irwin | 135/143 |
| 4,778,090 | A | * | 10/1988 | Facchina | 224/153 |
| 4,878,258 | A | * | 11/1989 | Casey | 160/368.1 |
| 4,986,389 | A | * | 1/1991 | Halligan et al. | 160/368.1 |
| 5,062,234 | A | * | 11/1991 | Green | 135/901 |
| 5,116,056 | A | * | 5/1992 | Schmutte | 160/330 |
| 5,147,102 | A | * | 9/1992 | Dyer, Jr. | 294/152 |
| D332,126 | S | * | 12/1992 | Smith | D21/800 |
| 5,197,239 | A | * | 3/1993 | Glynn et al. | 160/84.01 |
| 5,407,178 | A | * | 4/1995 | Long | 256/45 |
| 5,427,169 | A | * | 6/1995 | Saulters | 160/368.1 |
| 5,435,524 | A | * | 7/1995 | Ingram | 256/12.5 |
| 5,634,638 | A | * | 6/1997 | Havens et al. | 135/128 |
| 5,638,642 | A | * | 6/1997 | Nemec | 52/3 |
| 5,680,893 | A | * | 10/1997 | Neer | 160/330 |
| 5,732,935 | A | * | 3/1998 | Codario, Jr. | 256/1 |
| 5,768,722 | A | * | 6/1998 | Olson et al. | 135/119 |
| 5,857,679 | A | * | 1/1999 | Ringe et al. | 273/395 |

(Continued)

*Primary Examiner* — Victor MacArthur

(74) *Attorney, Agent, or Firm* — Jacqueline Tadros; Jacqueline Tadros, P.A.

(57) ABSTRACT

The present invention is a novel customizable and retractable enclosure system particularly suited for tennis courts. The customizable and retractable enclosure system of the present invention includes windscreen panel assemblies connected to vertical support members using a system of highly tensioned cables and eliminates the use of a chain link fence.

12 Claims, 9 Drawing Sheets

(56) References Cited

U.S. PATENT DOCUMENTS

| | | | | |
|---|---|---|---|---|
| 5,865,355 | A * | 2/1999 | Camara | 135/143 |
| 5,930,956 | A * | 8/1999 | Trosper et al. | 135/97 |
| 5,937,883 | A * | 8/1999 | Camara | 135/87 |
| 6,068,042 | A * | 5/2000 | Blond | 160/330 |
| 6,076,448 | A * | 6/2000 | Rexroad | 256/45 |
| 6,092,792 | A * | 7/2000 | Camara | 135/87 |
| 6,283,876 | B1 * | 9/2001 | Northcutt | 473/422 |
| 7,231,954 | B2 * | 6/2007 | Green | 160/350 |
| 7,320,353 | B1 * | 1/2008 | Miller et al. | 160/89 |
| 7,429,225 | B1 * | 9/2008 | Shull | 473/494 |
| 7,461,485 | B2 * | 12/2008 | Toledo | 52/222 |
| 7,475,868 | B1 * | 1/2009 | Gibbs | 256/23 |
| 7,523,778 | B2 * | 4/2009 | Roberts et al. | 160/237 |
| 7,600,554 | B1 * | 10/2009 | Wright et al. | 160/327 |
| 7,610,727 | B2 * | 11/2009 | Toledo | 52/222 |
| 7,691,465 | B2 * | 4/2010 | Bukovitz et al. | 428/99 |
| 8,397,738 | B2 * | 3/2013 | Livacich et al. | 135/90 |
| 2004/0221973 | A1 * | 11/2004 | Hesse | 160/368.1 |
| 2006/0277835 | A1 * | 12/2006 | Duffy | 52/39 |
| 2007/0125994 | A1 * | 6/2007 | Henning | 256/12.5 |
| 2007/0138456 | A1 * | 6/2007 | Clark | 256/24 |
| 2008/0173854 | A1 * | 7/2008 | Meaux et al. | 256/23 |
| 2009/0194297 | A1 * | 8/2009 | Ortiz Teruel | 169/50 |
| 2010/0116446 | A1 * | 5/2010 | Willett | 160/368.1 |

* cited by examiner

CUSTOMIZABLE ENCLOSURE SYSTEM FOR TENNIS COURTS

BACKGROUND OF THE INVENTION

1. Field of the Invention

The invention relates generally to enclosures for tennis courts and more particularly to a convertible, retractable and customizable enclosure system for tennis courts that includes windscreen panels, highly tensioned cables and fasteners.

2. Description of Related Art

Traditionally tennis courts employ the use of chain link fences as a means of ball containment. It is known in the art to use windscreens in conjunction with a chain link fence to block the wind, provide a background for the ball, enhance privacy and add security.

For example U.S. Pat. Appl. No. 2010/0116446 (to Willett) discloses a windscreen assembly for attachment to a fence. In Willett, a windscreen system includes mounting panels that are affixed to a fence, with a main windscreen sheet attachable to the mounting panels.

Another problem that arises with the use of windscreen panels used in conjunction with barriers, such as chain link fences, is that high wind oftentimes causes the windscreen to become detached from the chain link fence and become damaged. The constant detachment of the screens from the chain link fence also creates a maintenance problem by having to replace the fastening mechanisms regularly. Additionally, if the windscreens are not removed when a wind storm approaches, the chain link fence itself is at risk of completely blowing down as most are not designed to withstand the windloads with the windscreen attached.

In an attempt to limit the damage, prior art designs include one or more holes or flaps in the windscreen to allow the wind to blow through the covers and reduce the billowing or flapping effects. However, the prior art has achieved limited success in addressing the issue of windscreen or fence blowing down in heavy wind.

U.S. Pat. Appl. No. 2007/0138456 (to Clark) discloses a device and method relating to a cover for a barrier, such as for a fence or the like which allows the cover to be secured to a barrier so that the cover remains substantially against the barrier. The barrier cover has a front and rear portion. The rear portion has an upper pocket, a lower pocket and at least one web and apertures. The upper and lower pockets may have flexible support members extending therethrough. The web may be located between the upper pocket and the lower pocket. The web may define a plurality of pockets oriented substantially transverse to the upper pocket and the lower pocket.

Henning patent application U.S. Pat. Appl. No. 2007/0125994 discloses a wind shield system for mounting on a fence. The Henning reference teaches an apparatus and method for shielding an area from wind comprising at least one windscreen that yields to wind to facilitate, reduce or eliminate stresses or forces on a fence to which a windscreen is attached.

The continued use of chain link fences presents several difficulties and inconveniences. Chain link fences tend to rust and are difficult to assemble and disassemble. In addition, chain link fences are particularly susceptible to high winds and other environmental hazards. Further, chain link fences have often been described as aesthetically unappealing.

It is therefore desirable to have an eco-friendly, durable and customizable enclosure system for tennis courts that is simple to assemble or disassemble and that also provides the added benefit of being retractable and also dispenses with the use of a chain link fence.

SUMMARY OF THE INVENTION

The present invention provides a customizable enclosure system for tennis courts that also eliminates the use of chain link fences.

The present invention utilizes a plurality of windscreen panels that are connected to highly tensioned cables via the use of fasteners, such as snap clips or zip ties. The windscreen panels are composed of a resilient fabric comprising a thermoplastic polymer, most commonly a vinyl-coated polyester. The windscreen panels are retractable and may be easily slid along the tensioned cables to allow for retraction of the windscreen panels in order to open the enclosure. It may be advantageous to retract the windscreen panels and open the enclosure for various reasons, including the need to minimize damage to the windscreens in the event of inclement weather, including high winds and hurricanes or to enjoy an otherwise unblocked view.

The present invention requires the installation of two or more vertical support members in a concrete foundation at prescribed distances. Once the vertical support members are installed, high working load, corrosion resistant stainless steel cables are connected to the vertical support members. Preferably, the cables are a rigid low-flex, 1×19, 3/16 inch, wire rope uncoated stainless steel with a rounder profile shape. Preferably, the cables have a relatively high breaking load.

The cables are connected to the vertical support members via toggle with captive pin or bolt and nut to a compression clamp or eye bolt. A closed-body turnbuckle assembly is utilized to tension each length of cable. Preferably, a closed-body turnbuckle is used, because the closed turnbuckle assembly provides for a smoother transition from cable to fittings.

At least two cables extend horizontally from the top and bottom of a first vertical support member to the corresponding top and bottom of a second vertical support member positioned at a prescribed distance from the first vertical support member. In a preferred embodiment, at least three cables extend horizontally from the top, middle and bottom regions of a first vertical support member to a second vertical support member.

The windscreen panels include seams positioned at the top, middle and bottom of each windscreen panel. The top and bottom windscreen panel seams include spaced apertures, slots or grommets for receiving a fastener or snap clip to secure the windscreen panel to the top and bottom of the tensioned cables. In an alternative embodiment, a mounting panel or tab is affixed to the top and bottom portion of the windscreen panel seams to act as an accent.

The windscreen panels are further provided with end pockets for receiving support poles to allow tensioning along the full height of the windscreen panel. Adjoining support pole members are affixed together using fasteners, for example zip ties and the like. Alternatively, the pole members may be secured directly to the vertical support members.

The enclosure system of the present invention provides a foundation for customization capabilities not easily achieved by chain link systems.

An advantage of the present invention is that the system requires less structural support than a traditional chain link fence. Another advantage is that the present invention requires fewer and lighter weight components than a traditional chain link fence.

Still another advantage is that the present invention is not susceptible to corrosion in the same manner as a chain link fence.

Yet another advantage is that the system of the present invention is customizable and retractable. Another advantage is that the system of the present invention is environmentally friendly. Another advantage is that the system of the present invention is that eliminates the need for a chain link fence.

BRIEF DESCRIPTION OF DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE DRAWINGS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

The subject invention, dispenses with the use of a chain link fence and provides a novel improvement over other tennis enclosures using closed body turnbuckle assemblies with toggles and captive pins and multiple rigid steel cables to connect two vertical support members at corresponding top, mid and bottom points, and thereafter connecting a windscreen panel to the cables and vertical support members along a horizontal plane at said corresponding top, mid and bottom points.

The present invention contemplates the use of a windscreen panel 12 secured to a plurality of highly tensioned cables 14, 14' and 14" to form a windscreen panel assembly 10. A plurality of said windscreen panel assemblies 10 may thereafter be joined to form a customizable enclosure system that is ideal for tennis courts and dispenses with the use of chain link fences.

Figure 1:
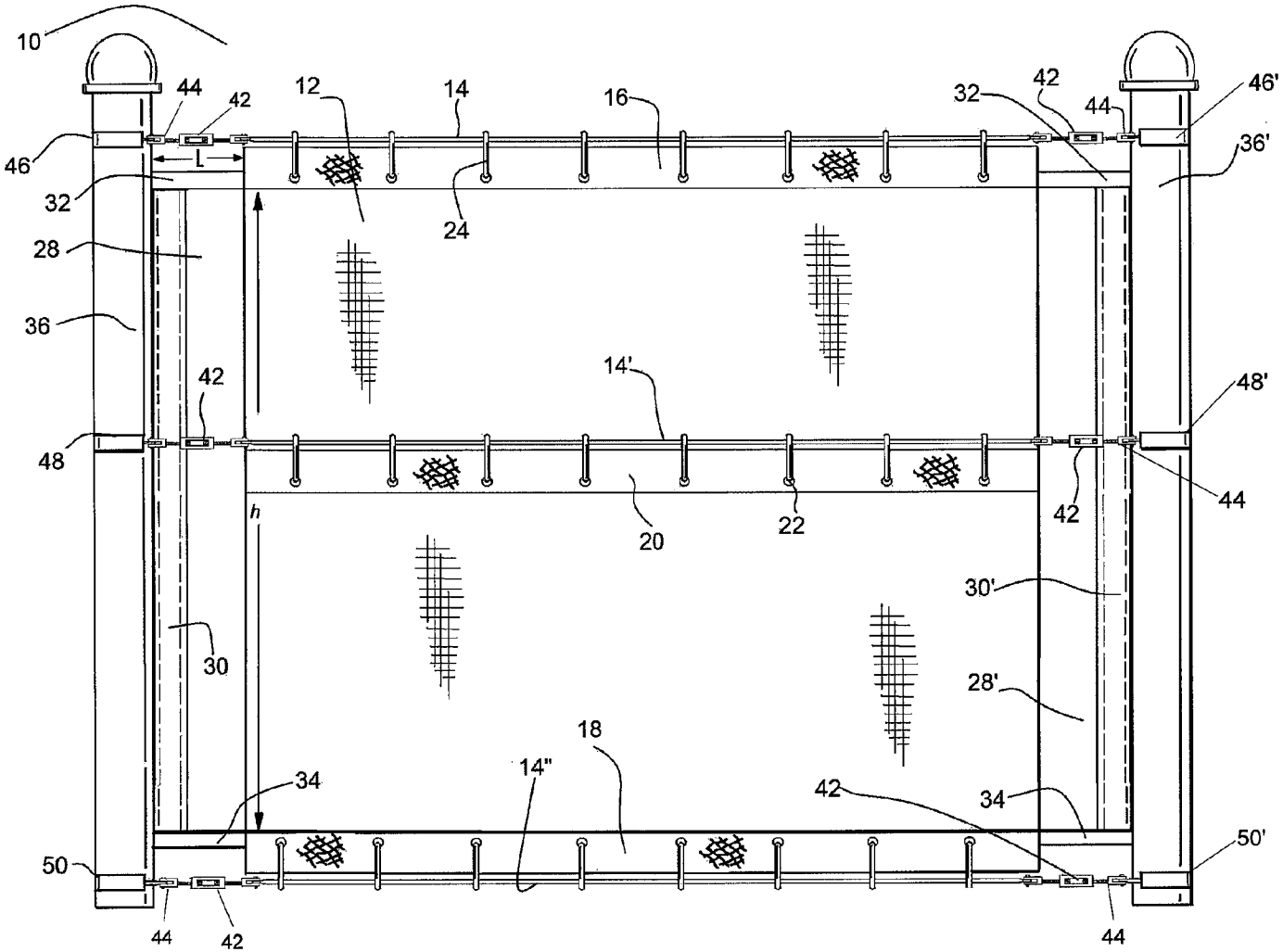
FIG. 1 is a windscreen panel assembly of the customizable enclosure system of the present invention affixed to two supporting members.

Referring now to FIGS. 1 to 10, the windscreen panel 12 is preferably composed of a resilient fabric, such as vinyl-coated polyester. A windscreen panel 12 as shown in FIG. 1 includes first and second reinforced seams 16, 18 positioned along a horizontal plane along the length of the top and bottom edges of the windscreen panel 12. A third reinforced seam 20 is positioned along a horizontal plane along the center of the windscreen panel 12 at a general midpoint relative to the first and second reinforced seams 16, 18.

Figure 10:
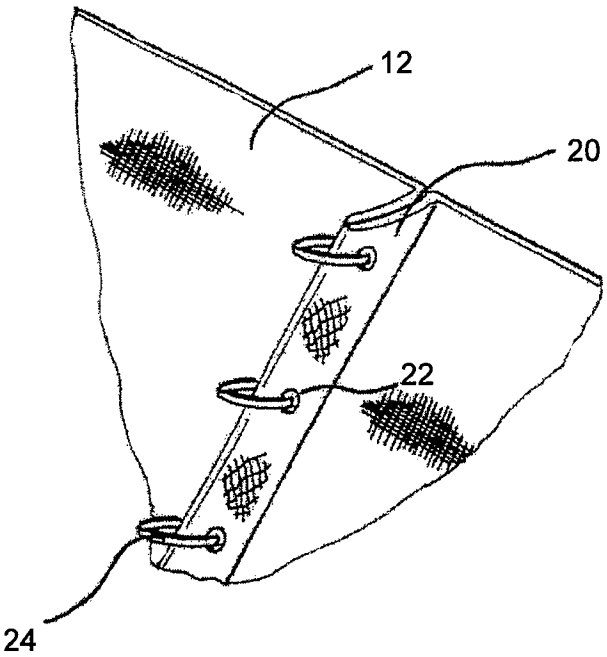
FIG. 10 is a close-up perspective view of a seam positioned at a mid point of a windscreen panel of the customizable enclosure system of the present invention

In a preferred embodiment each windscreen panel 12 has a height in a range of eight to ten feet and a length in a range of twenty to thirty feet. The third reinforced seam may be positioned at a general midpoint of four to six feet. In an alternative embodiment, a windscreen panel 12 may have a height of six feet. Where the windscreen panel 12 has a height of six feet or less, the windscreen panel 12 will include only first and second reinforced seams 16, 18. A third reinforced seam 20 is found to be necessary only in windscreen panels 12 with a height in excess of six feet. In a preferred embodiment, the third reinforced seam 20 is formed by first joining then sealing together seamed edges of two windscreen panels 12 as shown in FIG. 10.

Figure 2:
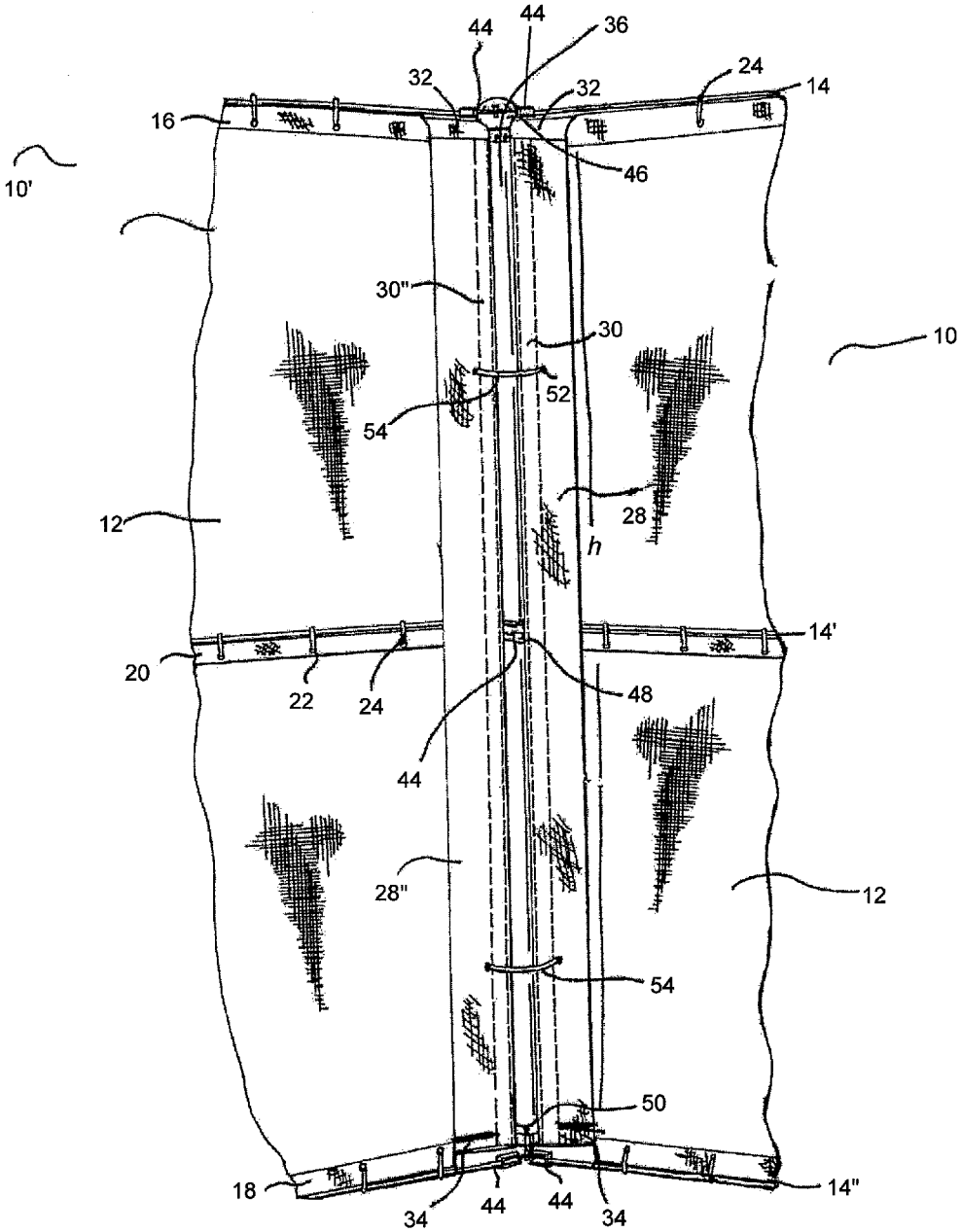
FIG. 2 is a partial view of two windscreen panel assemblies of the customizable enclosure system of the present invention affixed to a common supporting member.
Figure 8:
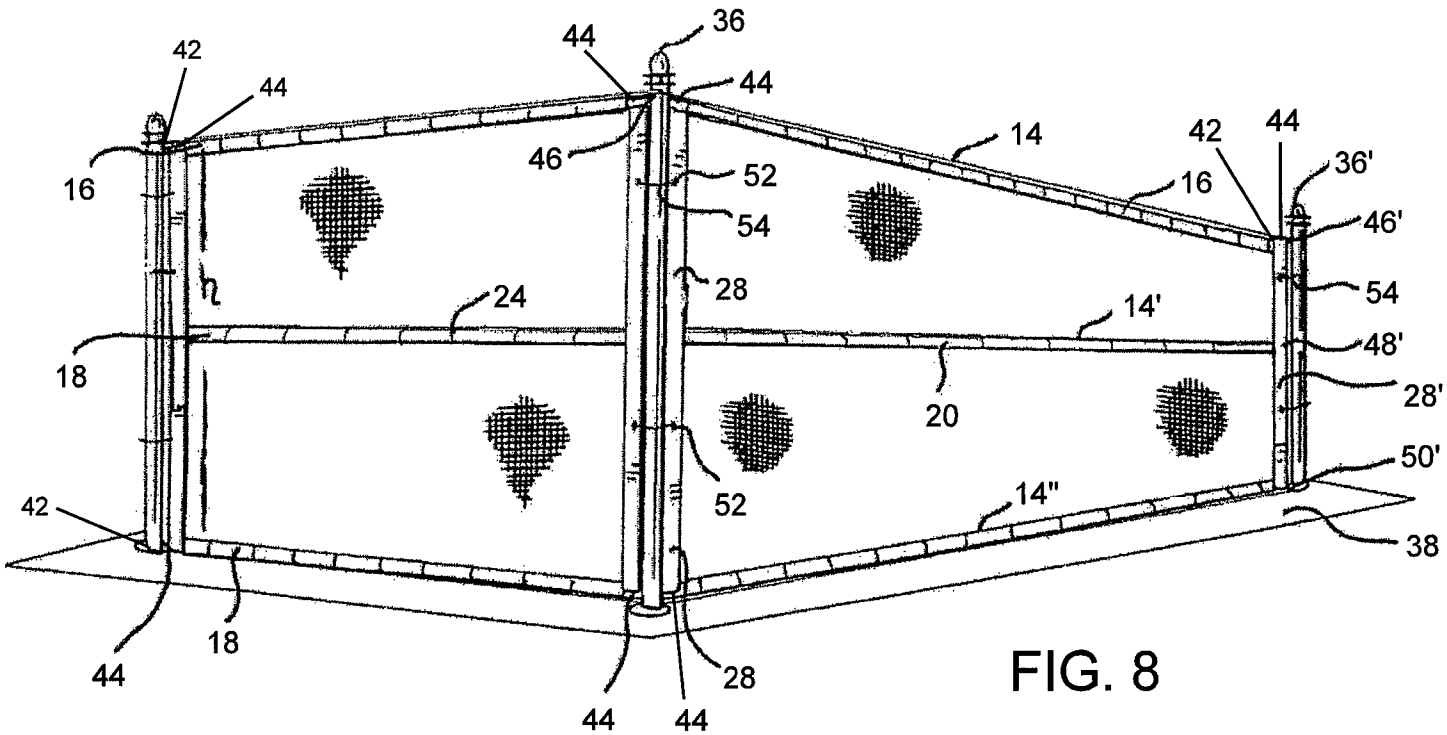
FIG. 8 is a side perspective view of an embodiment of the customizable enclosure system of the present invention in operation.

Referring to FIGS. 1, 2 and 8, a plurality of substantially evenly spaced grommets 22 are located along the first, second and third reinforced panel seams 16, 18, 20. In a preferred embodiment, the grommets 22 may be positioned twelve inches apart along the length of each of the first, second and third reinforced panel seams 16, 18, 20 as shown in FIG. 1. The grommets are sized to receive fasteners, such as for example highly resistant plastic snap clips 24 as more clearly shown in FIGS. 1 to 7. Snap clips 24 are preferred because they are resilient, easily removable, replaceable and cost effective.

Each windscreen panel 12 includes a pocket 28 positioned on either end of the windscreen panel 12 along a vertical plane relative to the first, second and third reinforced panel seams 16, 18 and 20. The pockets 28 and 28' extend beyond the main windscreen panel 12 along the height, h, of the windscreen panel 12 as shown in FIGS. 1, 2 and 8. The length, L, of the pockets 28 and 28' is preferably four inches whereas the height of the pockets 28 and 28" is substantially the same height as the windscreen panel 12.

Each pocket 28, 28' is fabricated from the same material as the windscreen panel 12, namely a resilient fabric such as vinyl-coated polyester.

Figure 4:
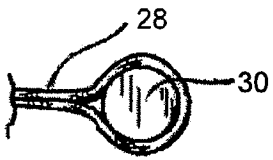
FIG. 4 is a top view of a portion of a windscreen panel assembly taken along line 4-4 of FIG. 3
Figure 3:
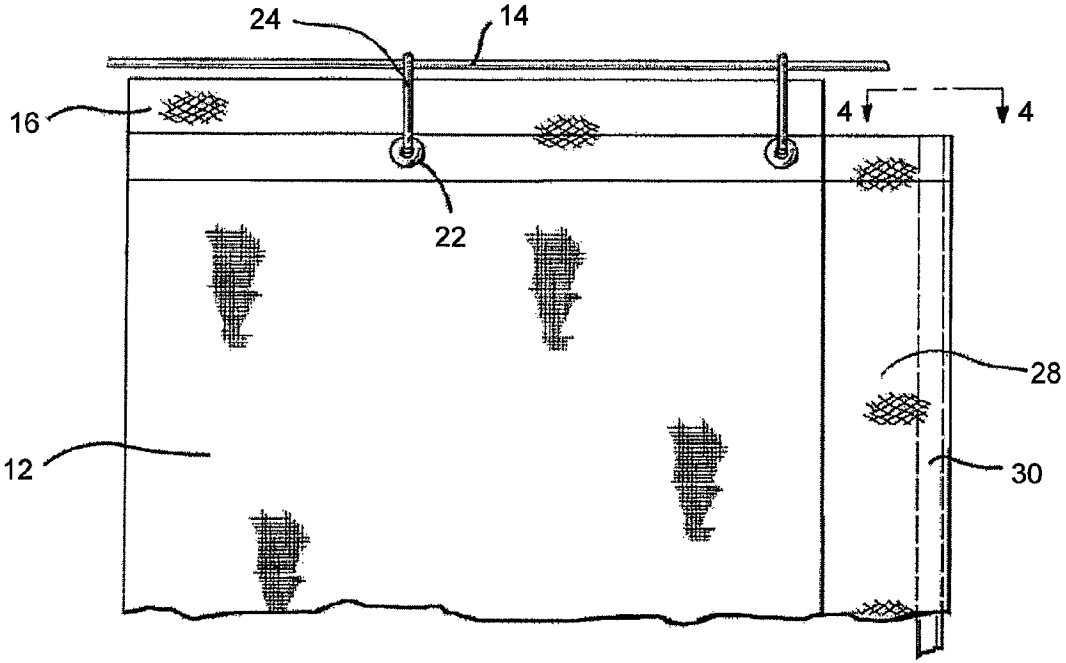
FIG. 3 is a partial view of a windscreen panel assembly of the customizable enclosure system of the present invention suspended from a cable.

Referring now in particular to FIGS. 3-4, the pocket 28 is formed by folding a panel flap and sealing the folded flap to the windscreen panel 12 along the length of the windscreen panel 12. The flap may be sealed to the windscreen panel using a nylon stitching or other suitable means as will be appreciated by one reasonably skilled in the art.

Referring to FIGS. 1 to 7, the pocket 28 is dimensioned to receive a rigid support pole 30. The pockets 28 include reinforced seams at top and bottom edges 32, 34. As shown in FIG. 1, poles 30, 30' are positioned within the pockets 28, 28' distal to the sealed seam that runs along the height, h, of the windscreen panel 12. Thus, a rigid pole 30, 30' is secured within each of the sealed pockets 28, 28' for tensioning the windscreen panel 12 along a vertical plane at either end of the windscreen panel 12 as shown in FIG. 1.

In one preferred embodiment, the present invention utilizes three cables 14, 14' and 14" to secure a windscreen panel 12 to vertical support members 36, 36'. An important aspect of the present invention is that the cables 14, 14' and 14" are fabricated of a low-flex, as opposed to flexible steel. The cables 14, 14' and 14" comprise a rigid steel, capable of securing a high working load and a high breaking load. In a preferred embodiment, cables 14, 14' and 14" comprise 1×19 uncoated wire rope, 3/16 inch rigid stainless steel having a round profile shape.

Figure 6:
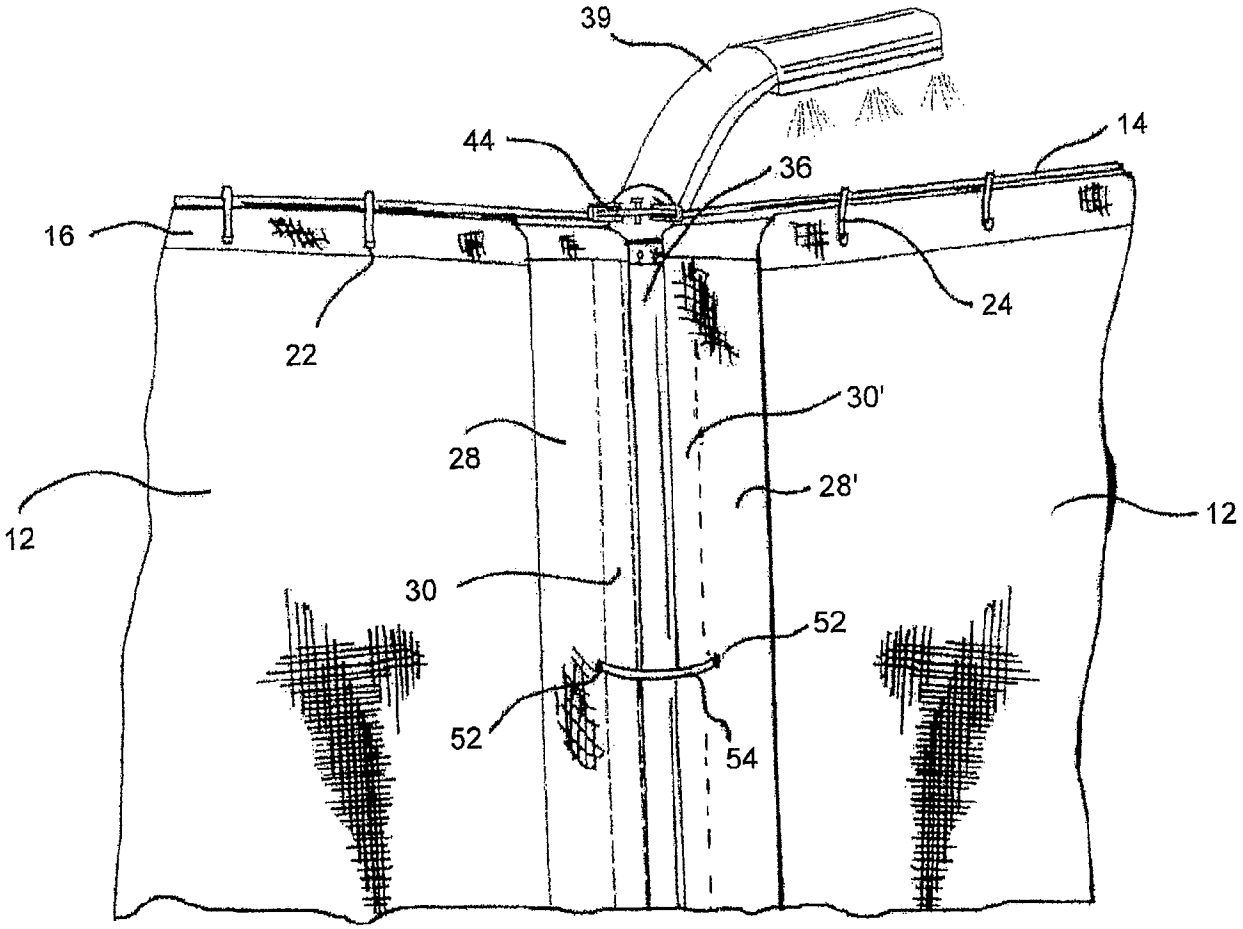
FIG. 6 is a partial view of two windscreen panel assemblies of the customizable enclosure system of the present invention affixed to a common supporting member with a light fixture affixed to the supporting member.
Figure 7:
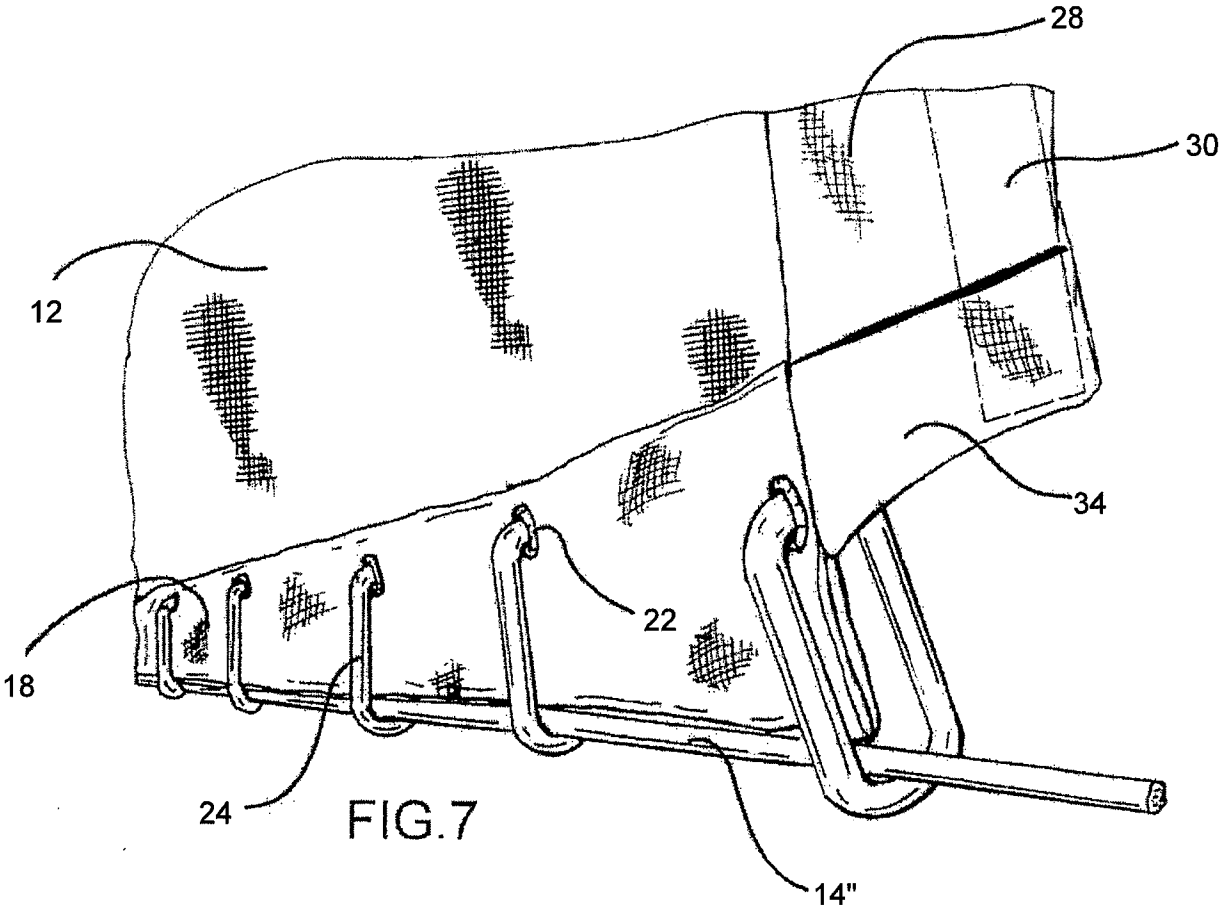
FIG. 7 is a partial side perspective view of the bottom portion of a windscreen panel of the customizable enclosure system of the present invention affixed to a cable.

The vertical support members 36, 36' may be formed of steel, aluminum, wood or other suitable material as will be appreciated by one reasonably skilled in the art. The vertical support members 36, 36' are permanently affixed in bedrock or a concrete foundation 38 at prescribed distances as shown in FIG. 8. The vertical support members 36, 36' may also include additional accessories, such as, for example, a light fixture 39 as shown in FIG. 6.

Once the vertical support members 36 are permanently affixed to the concrete 38, cables 14, 14' and 14" are secured to vertical support members 36 as shown in FIG. 8. The cables 14, 14' and 14" may be secured to the vertical support members 36, 36' using fastening means, such as for example a toggle with captive pin 44 to a clamp compression system or a closed body turnbuckle assembly 42 with toggle and captive pin 44 to a clamp compression system as shown in FIGS. 1, 5 and 8.

Figure 5:
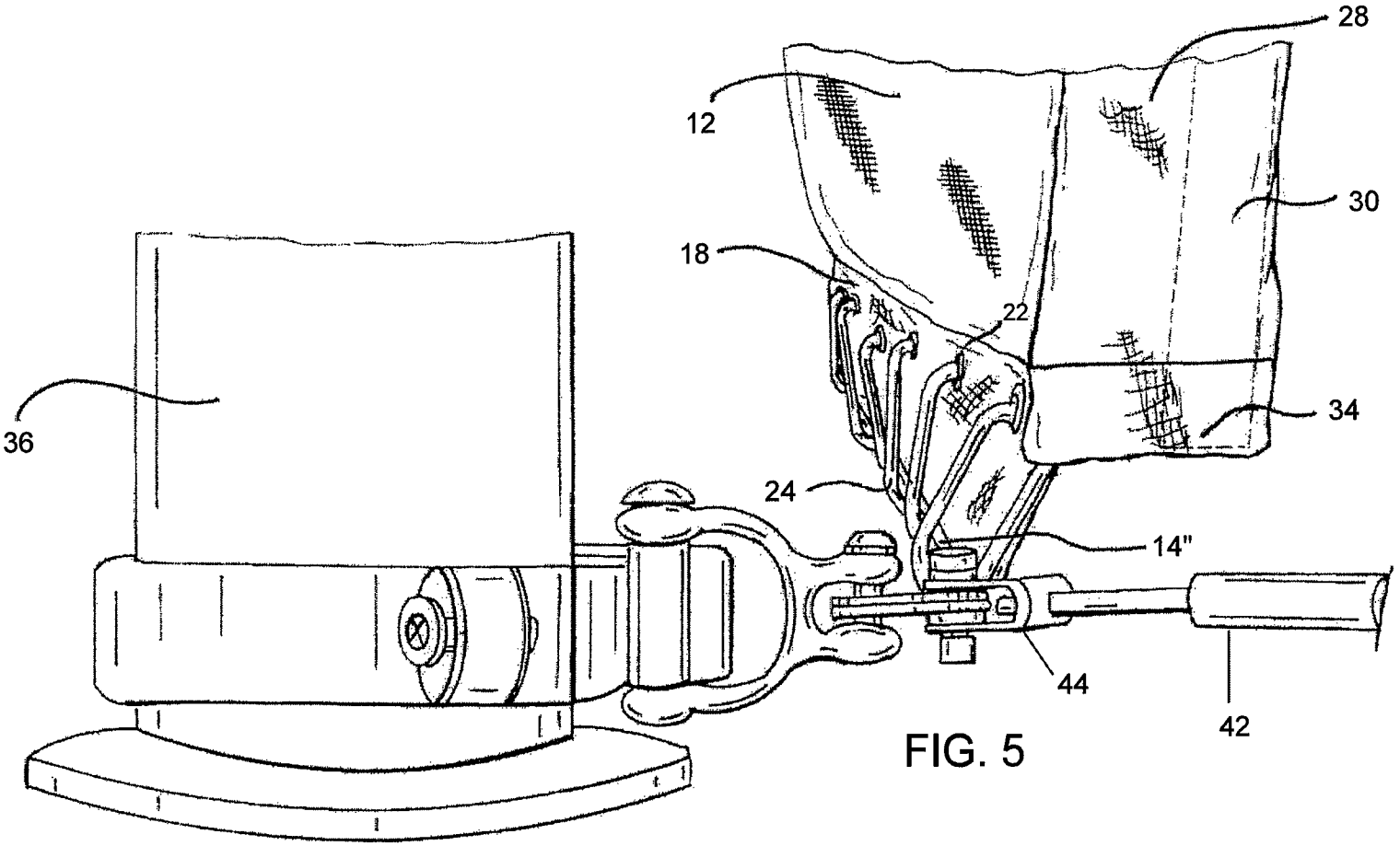
FIG. 5 is a partial perspective view of the bottom portion of a windscreen panel assembly of the customizable enclosure system of the present invention affixed to a supporting member

A closed-body turnbuckle assembly 42 with toggle 44 may be used to tension and secure a cable 14" to a supporting member 36 as shown in FIG. 5. A closed-body turnbuckle assembly 42 has been found to provide for a smoother transition from cable 14, 14' and 14" to the attachment point on vertical support members 36, 36' as shown in FIGS. 1, 5 and 8. The closed-body turnbuckle assembly 42 preferably includes a toggle 44 to assist in wear resistance. Alternate fastening means may be used to secure cables 14, 14' and 14" to the vertical support members as will be readily appreciated by one reasonably skilled in the art.

Referring now to FIGS. 1 to 2, 5 to 6, and 8 to 9, cables 14, 14' and 14" are fixedly secured to vertical support members 36 and 36' at a top point 46, mid point 48 and bottom point 50 using a closed-body turnbuckle assembly 42. The cables 14, 14' and 14" are thereby highly tensioned and taut. In utilizing highly rigid steel cable to secure the windscreen panels 12 to the vertical support members 36, 36' at a top 46, mid 48 and bottom point 50, the subject invention provides a novel improvement over other enclosure systems.

It should be appreciated that the cables 14, 14', 14" may be tensioned via tensioning means, such as the closed-body turnbuckle assembly 42 to one or more vertical support members 36 from either end of the length of each of the cables 14, 14', 14". However, the cables 14, 14', 14" need not be tensioned from both ends of the length of each cable 14, 14', 14", and may be tensioned from only one end using the closed-body turnbuckle assembly 42.

In a preferred embodiment, cable 14 is fixedly attached to corresponding vertical support members 36, 36' at a top point 46, located generally 4 to 6 inches from the apex of the first and second vertical support members 36, 36' as shown in FIG. 1. Similarly, cables 14' and 14" connect the vertical support members 36, 36' at corresponding mid 48, 48' and bottom points 50, 50'.

Referring to FIG. 1, the windscreen panel assembly 10 including the windscreen panel 12 and rigid support pole members 30, 30' enclosed within pockets 28 and 28', located on either side of the windscreen panel 12 is thereafter affixed to the cables 14, 14' and 14" that are now connecting the vertical support members 36, 36' at top 46, 46', mid 48, 48' and bottom points 50, 50'.

Fasteners or plastic snap clips 24 pass through the grommets 22 positioned along the first reinforced windscreen panel seam 16 to affix the windscreen panel 12 to cable 14. Similarly, fasteners or plastic snap clips 24 pass through the grommets 22 positioned along the second reinforced windscreen panel seam 18 to affix the windscreen panel 12 to the cable 14" connecting corresponding vertical support members 36, 36' at a corresponding bottom points 50, 50'.

Cable 14' connecting corresponding vertical support members 36, 36' at mid point 48, 48' is connected to the third reinforced panel seam 20 positioned along the center of the windscreen panel 12 using fasteners such as, for example snap clips 24.

FIG. 2 is a partial view of two windscreen panel assemblies 10 of the customizable enclosure system of the present invention affixed to a common supporting member 36.

The pockets 28 of the windscreen panel assembly 10 include two apertures 52 positioned generally at a point ¼ from the apex of the pole 30 and two apertures 52 positioned ¾ from the apex of the pole. The apertures 52 are sized to receive a zip tie 54 for securing a rigid pole support member 30 of a first windscreen panel assembly 10 to an adjacent rigid pole support members 30" of a second windscreen panel assembly 10' when two or more windscreen panels are in a neighboring configuration as shown in FIGS. 2, 6 and 8. The zip tie 54 passes through a first and second apertures 52 to wrap around the pole support member 30 of a first windscreen panel assembly 10 and thereafter passes through corresponding aperture 52 of a pocket 28" of a second windscreen panel assembly 10' to wrap around the adjacent rigid pole support members 30" of the second windscreen panel assembly 10'. The zip tie 54 emerges from the aperture to fasten adjacent poles 30 and 30" together.

In an alternative embodiment, a fastener, such as for example a zip tie may be used to secure two adjacent rigid pole members 30, 30" with a common vertical support member 36.

Figure 9:
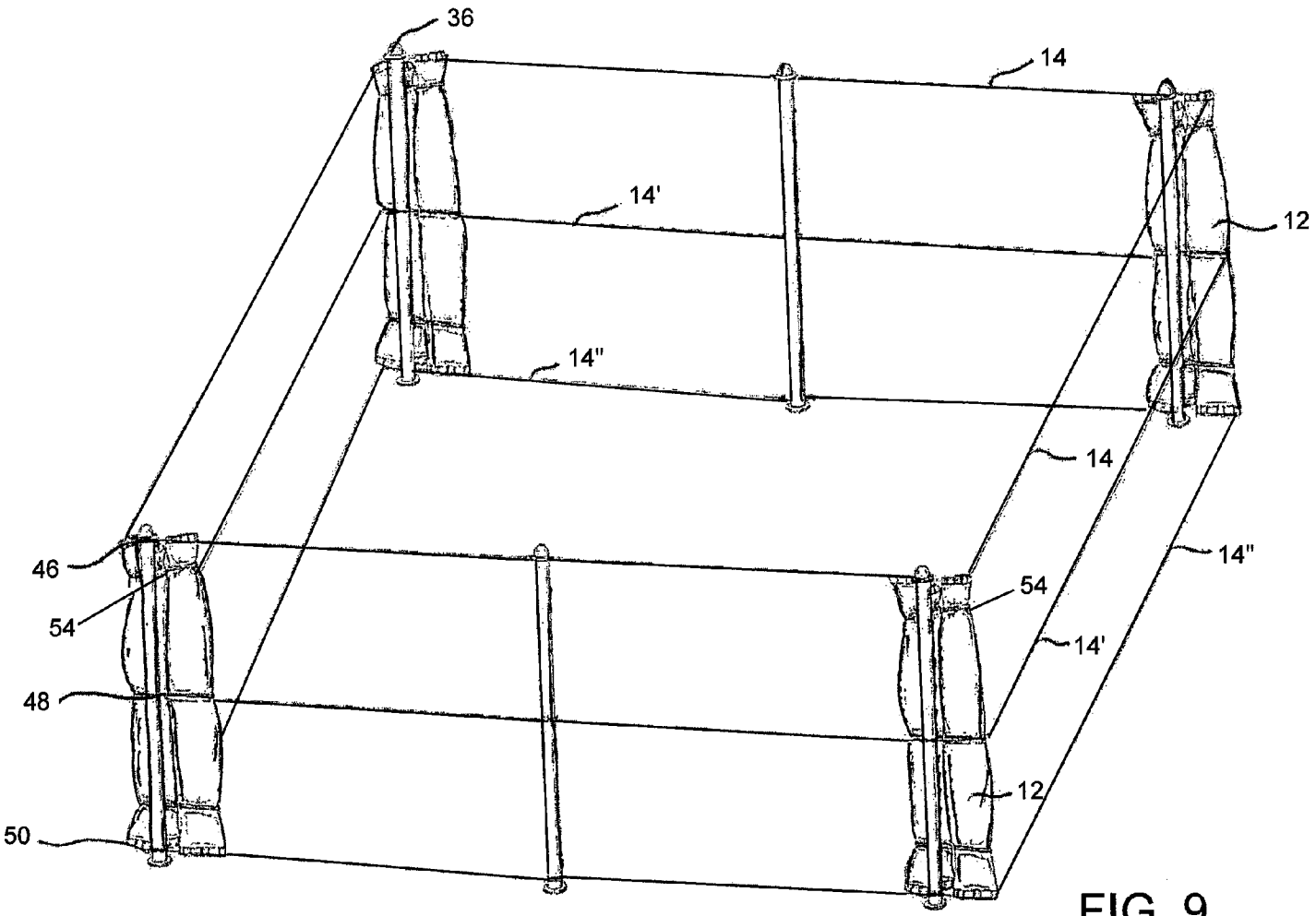
FIG. 9 illustrates an embodiment of the customizable enclosure system of the present invention with the windscreen panels in a retracted state.

The windscreen panel 12, once affixed to the cables 14, 14' and 14" may be easily retracted as shown in FIG. 9. The zip ties or fastening means securing the adjoining rigid pole members 30, 30" to one another, or alternatively, securing the adjoining rigid pole members 30, 30" to a first vertical support member 36 may be severed using a simple wire snipping tool.

The windscreen panel 12 affixed to the snap clips 24 is pushed along cables 14, 14' and 14" where it slides into a retracted position and is gathered accordion style. Once retracted, the windscreen panel 12 may be tied together at a top 46 and bottom 50 position as shown in FIG. 9. The retracted windscreen panel 12 is further secured to the second vertical support member 36' using fasteners, such as for example, zip ties. As will be appreciated by one reasonably skilled in the art, the windscreen panel 12 may be secured by a number of other suitable means.

In an alternative embodiment, if the windscreen panel 12 does not exceed six feet in height, there is no need for a third reinforced seam 20 and the windscreen panel 12 will be secured to vertical support members 36 and 36' with cables 14 and 14" along a first and second reinforce seam 16, 18.

A rectangular configuration as disclosed is ideal for a tennis court enclosure as illustrated in FIG. 9. As will be appreciated, the enclosure system of the present enclosure may include other configurations, including a square, hexagon, or other geometric configurations or combinations thereof.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A customizable enclosure system comprising: (a) at least two vertical support members fixedly attached in a concrete foundation at prescribed distances; (b) at least two cables for connecting the at least two vertical support members, the at least two cables suspended along a horizontal direction at a predetermined distance from one another and running substantially parallel to one another, wherein a first cable of the at least two cables is fixedly attached to a first vertical support member, of the at least two vertical support members, and positioned at a top point measured from an apex of the first vertical support member and is fixedly attached to a second vertical support member, of the at least two vertical support members, at a corresponding top point measured from an apex of the second vertical support member; and a second cable of the at least two cables is attached to the first vertical support member and positioned at a relative bottom point, distal to the top point, measured from the apex of the first vertical support member and is fixedly attached to a second vertical support member at a corresponding bottom point distal to the top point, measured from the apex of the second vertical support member; (c) fastening means for fixedly attaching the first cable to the first vertical support member at the top point of the first vertical support member and the corresponding top point of the second vertical support member and for fixedly attaching the second cable to the first vertical support at the bottom point of the first vertical support member and the corresponding bottom point of the second vertical support member; (d) tensioning means for tensioning the first cable to a vertical support member at the top point of the vertical support member and for tensioning the second cable to a vertical support member at the bottom point of the vertical support member; (e) a windscreen panel having at least two reinforced seams, a first reinforced seam, of the at least two reinforced seams, disposed on a horizontal direction along the length thereof of a top edge of the windscreen panel; a second reinforced seam, of the at least two reinforced seams, disposed on a horizontal direction along the length thereof of a bottom edge of the windscreen panel, the first and second reinforced seams further including a plurality of grommets wherein the grommets are substantially evenly spaced along the lengths of the top and bottom edges thereof; and (f) a first pocket defining a cavity, the first pocket being fixedly attached to the windscreen panel and extending vertically along the full height of a side of the windscreen panel between the first and second reinforced seams for receiving a rigid support member for tensioning the windscreen panel.

2. The customizable enclosure system of claim 1 further comprising: (a) a second pocket defining a cavity, the second pocket being fixedly attached to the windscreen panel and extending vertically along the full height of a side of the windscreen panel between the first and second reinforced seams, for receiving a rigid support member for tensioning the windscreen panel; (b) a first rigid support member positioned within the first pocket for tensioning the windscreen panel; (c) a second rigid support member positioned within the second pocket for tensioning the windscreen panel in a direction opposite to the first support member; and (d) fastening means for securing the windscreen panel to the cables along the first and second reinforced seams.

3. The customizable enclosure system of claim 2, wherein the windscreen panel further comprises a third reinforced seam positioned along a horizontal direction along a center of the windscreen panel at a general midpoint relative to the first and second reinforced seams, the third reinforced seam further including a plurality of grommets wherein the grommets are substantially evenly spaced along the length of the third reinforced seam and further including fastening means for securing the windscreen panel to the third cable along the third reinforced seam.

4. The windscreen panel assembly of claim 3, wherein the third reinforced seam is formed by first joining then sealing together seamed edges of a first and second windscreen panel.

5. The customizable enclosure system of claim 1, wherein a third cable connects the at least two vertical support members, the three cables suspended along a horizontal direction at a predetermined distance from one another and running substantially parallel to one another, wherein the third cable is fixedly attached to the first vertical support member and positioned along a horizontal direction at a general midpoint relative to the first and second cables and is fixedly attached to the second vertical support member at a corresponding midpoint relative to the first and second cables.

6. The customizable enclosure system of claim 1, wherein the fastening means for securing the at least two cables to the at least two vertical support members includes a toggle and captive pin system.

7. The customizable enclosure system of claim 1, wherein the tensioning means includes a closed body turnbuckle assembly.

8. The customizable enclosure system of claim 1, wherein the at least two cables are comprised of rigid steel capable of securing a high working load and a high breaking load, the cables being further defined as 1.times.19 uncoated wire rope having a round profile shape.

9. The customizable enclosure system of claim 8, wherein the at least two cables have a diameter of substantially 3/16 inches.

10. The customizable enclosure system of claim 1, further comprising a plurality of windscreen panel assemblies disposed in neighboring configuration to form a tennis enclosure, the windscreen panel assemblies each comprising: (a) a windscreen panel having at least two reinforced seams, a first reinforced seam, of the at least two reinforced seams, disposed on a horizontal direction along the length thereof of a top edge of the windscreen panel; a second reinforced seam, of the at least two reinforced seams, disposed on a horizontal direction along the length thereof of a bottom edge of the windscreen panel, the first and second reinforced seams further including a plurality of grommets wherein the grommets are substantially evenly spaced along the lengths of the top and bottom edges thereof; (b) a first pocket defining a cavity, the first pocket being fixedly attached to the windscreen panel and extending vertically along the full height of a side of the windscreen panel between the first and second reinforced seams, for receiving a rigid support member for tensioning the windscreen panel; (c) a second pocket defining a cavity, the first pocket being fixedly attached to the windscreen panel and extending vertically along the full height of a side of the windscreen panel between the first and second reinforced seams, for receiving a rigid support member for tensioning the windscreen panel; (d) a first rigid support member positioned within the first pocket for tensioning the windscreen panel; (e) a second rigid support member positioned within the second pocket for tensioning the windscreen panel in a direction opposite to the first support member; and (f) fastening means for securing the windscreen panel to the cables along the first and second reinforced seams.

11. The customizable enclosure system of claim 10, wherein a first support member of a windscreen panel assembly is affixed to a second support member of an adjoining windscreen panel assembly.

12. The customizable enclosure system of claim 11, wherein the first support member of the windscreen panel assembly, and the second support member of the adjoining windscreen panel assembly are affixed to a common vertical support member.

* * * * *